US009528704B2

(12) United States Patent
Hughes et al.

(10) Patent No.: US 9,528,704 B2
(45) Date of Patent: Dec. 27, 2016

(54) COMBUSTOR CAP HAVING NON-ROUND OUTLETS FOR MIXING TUBES

(71) Applicant: General Electric Company, Schenectady, NY (US)

(72) Inventors: Michael John Hughes, Pittsburgh, PA (US); Gregory Allen Boardman, West Chester, OH (US); Johnie Franklin McConnaughhay, Greenville, SC (US); Carlo Antonio Arguinzoni, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 377 days.

(21) Appl. No.: 14/186,157

(22) Filed: Feb. 21, 2014

(65) Prior Publication Data

US 2015/0241065 A1 Aug. 27, 2015

(51) Int. Cl.
*F23R 3/28* (2006.01)
*F23R 3/16* (2006.01)

(52) U.S. Cl.
CPC ..... *F23R 3/286* (2013.01); *F23R 3/16* (2013.01); *F23R 3/283* (2013.01)

(58) Field of Classification Search
CPC ..... F02C 7/12; F02C 7/18; F02C 7/222; F05D 2260/22141; F23R 3/002; F23R 3/10; F23R 3/28; F23R 3/283; F23R 3/286; F23R 2900/03045
USPC ..... 60/772, 737, 740, 756, 746, 748
See application file for complete search history.

(56) References Cited

U.S. PATENT DOCUMENTS

| | | | |
|---|---|---|---|
| 4,686,823 | A | 8/1987 | Coburn et al. |
| 4,864,827 | A | 9/1989 | Richardson et al. |
| 4,870,818 | A | 10/1989 | Suliga |
| 4,934,146 | A | 6/1990 | Zeisser |
| 5,235,813 | A | 8/1993 | McVey et al. |
| 5,638,675 | A | 6/1997 | Zysman et al. |
| 5,638,682 | A | 6/1997 | Joshi et al. |
| 5,974,805 | A | 11/1999 | Allen |
| 6,530,223 | B1 | 3/2003 | Dobbs et al. |
| 6,871,501 | B2 | 3/2005 | Bibler et al. |
| 6,877,960 | B1 | 4/2005 | Presz, Jr. et al. |

(Continued)

OTHER PUBLICATIONS

U.S. Appl. No. 14/186,016, filed Feb. 21, 2014, Boardman et al.

*Primary Examiner* — Jason L Vaughan
(74) *Attorney, Agent, or Firm* — Fletcher Yoder, P.C.

(57) ABSTRACT

A system includes a a combustor cap configured to be coupled to a plurality of mixing tubes of a multi-tube fuel nozzle, wherein each mixing tube of the plurality of mixing tubes is configured to mix air and fuel to form an air-fuel mixture. The combustor cap includes multiple nozzles integrated within the combustor cap. Each nozzle of the multiple nozzles is coupled to a respective mixing tube of the multiple mixing tubes. In addition, each nozzle of the multiple nozzles includes a first end and a second end. The first end is coupled to the respective mixing tube of the multiple mixing tubes. The second end defines a non-round outlet for the air-fuel mixture. Each nozzle of the multiple nozzles includes an inner surface having first and second portions, the first portion radially diverges along an axial direction from the first end to the second end, and the second portion radially converges along the axial direction from the first end to the second end.

20 Claims, 8 Drawing Sheets

(56) References Cited

U.S. PATENT DOCUMENTS

| | | | | |
|---|---|---|---|---|
| 6,880,340 | B2 * | 4/2005 | Saitoh | F23D 14/70 60/737 |
| 6,898,937 | B2 | 5/2005 | Stuttaford et al. | |
| 7,137,254 | B1 * | 11/2006 | Dmitrievich | F02K 9/52 239/424 |
| 8,127,553 | B2 | 3/2012 | Ekkad et al. | |
| 8,181,891 | B2 * | 5/2012 | Ziminsky | F23D 14/48 239/132 |
| 8,205,452 | B2 * | 6/2012 | Boardman | F23R 3/12 60/737 |
| 8,307,660 | B2 | 11/2012 | Stewart et al. | |
| 8,479,519 | B2 | 7/2013 | Chen et al. | |
| 8,701,419 | B2 * | 4/2014 | Hughes | F23R 3/286 60/737 |
| 8,800,288 | B2 | 8/2014 | Kidder et al. | |
| 8,800,289 | B2 * | 8/2014 | Johnson | F01D 9/023 60/737 |
| 9,175,857 | B2 | 11/2015 | Melton et al. | |
| 2008/0011883 | A1 * | 1/2008 | Gerakis | F23D 11/38 239/533.2 |
| 2009/0184181 | A1 | 7/2009 | Berry et al. | |
| 2010/0263384 | A1 * | 10/2010 | Chila | F23R 3/10 60/755 |
| 2012/0285173 | A1 | 11/2012 | Poyyapakkam et al. | |
| 2012/0297787 | A1 * | 11/2012 | Poyyapakkam | B01F 5/0451 60/772 |
| 2013/0125550 | A1 * | 5/2013 | Prade | F23R 3/28 60/740 |
| 2013/0219897 | A1 * | 8/2013 | Nakamura | F02C 7/222 60/737 |
| 2013/0255264 | A1 * | 10/2013 | Hollon | F02M 61/163 60/740 |
| 2014/0060060 | A1 * | 3/2014 | Bernero | F23R 3/12 60/748 |

* cited by examiner

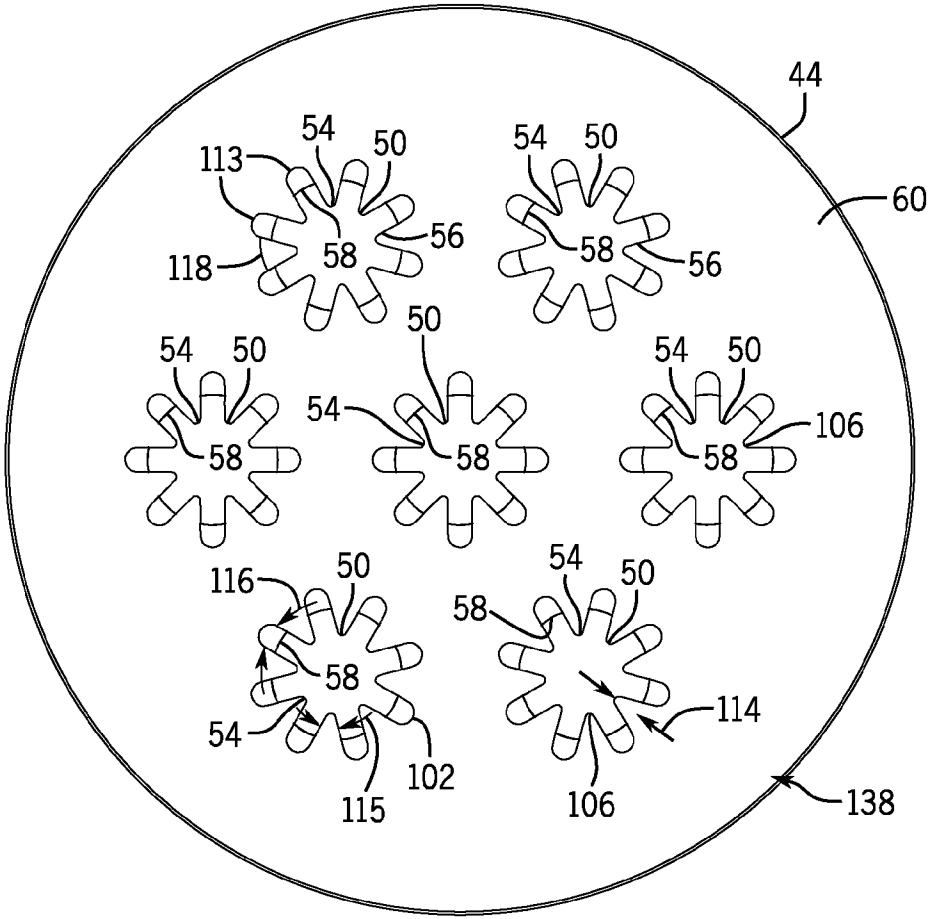
FIG. 5
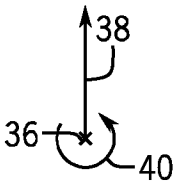

COMBUSTOR CAP HAVING NON-ROUND OUTLETS FOR MIXING TUBES

STATEMENT REGARDING FEDERALLY SPONSORED RESEARCH & DEVELOPMENT

This invention was made with Government support under contract number DE-FC26-05NT42643 awarded by the Department of Energy. The Government has certain rights in the invention.

BACKGROUND

The subject matter disclosed herein relates to combustors and, more specifically, to a combustor cap of a gas turbine engine.

A gas turbine engine combusts a mixture of fuel and air to generate hot combustion gases, which in turn drive one or more turbine stages. In particular, the hot combustion gases force turbine blades to rotate, thereby driving a shaft to rotate one or more loads, e.g., an electrical generator. The gas turbine engine includes one or more fuel nozzle assemblies to inject fuel and air into a combustor. The design and construction of the fuel nozzle assembly can significantly impact exhaust emissions (e.g., nitrogen oxides, carbon monoxide, etc.) as well as the life of components of the fuel nozzle assembly. Furthermore, the design and construction of the fuel nozzle assembly can significantly affect the time, cost, and complexity of installation, removal, maintenance, and general servicing. Therefore, it would be desirable to improve the design and construction of the fuel nozzle assembly.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes a combustor cap configured to be coupled to a plurality of mixing tubes of a multi-tube fuel nozzle, wherein each mixing tube of the plurality of mixing tubes is configured to mix air and fuel to form an air-fuel mixture. The combustor cap includes multiple nozzles integrated within the combustor cap. Each nozzle of the multiple nozzles is coupled to a respective mixing tube of the multiple mixing tubes. In addition, each nozzle of the multiple nozzles includes a first end and a second end. The first end is coupled to the respective mixing tube of the multiple mixing tubes. The second end defines a non-round outlet for the air-fuel mixture. Each nozzle of the multiple nozzles includes an inner surface having first and second portions, the first portion radially diverges along an axial direction from the first end to the second end, and the second portion radially converges along the axial direction from the first end to the second end.

In accordance with a second embodiment, a system includes a combustor cap configured to be coupled to multiple mixing tubes of a multi-tube fuel nozzle. Each mixing tube of the multiple mixing tubes is configured to mix air and fuel to form an air-fuel mixture. The combustor cap includes multiple nozzles integrated within the combustor cap. Each nozzle of the multiple nozzles is configured to couple to a respective mixing tube of the multiple mixing tubes. In addition, each nozzle of the multiple nozzles includes a first end and a second end. The first end is configured to couple to the respective mixing tube of the multiple mixing tubes. The second end defines a non-round outlet for the air-fuel mixture.

In accordance with a third embodiment, a system includes a combustor cap configured to be coupled to multiple mixing tubes of a multi-tube fuel nozzle. Each mixing tube of the multiple mixing tubes is configured to mix air and fuel to form an air-fuel mixture. The combustor cap includes multiple nozzles integrated within the combustor cap. Each nozzle of the multiple nozzles is configured to couple to a respective mixing tube of the multiple mixing tubes. In addition, each nozzle of the multiple nozzles includes a first end and a second end. The first end is configured to couple to the respective mixing tube of the multiple mixing tubes. The second end defines an outlet for the air-fuel mixture. An inner surface of each mixing tube of the multiple mixing tubes includes a first perimeter. An inner surface of the second end at the outlet of each nozzle of the multiple nozzles includes a second perimeter, and the second perimeter is larger than the first perimeter.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 5 is a front view of a hot side of the combustor cap of FIGS. 2-4 (e.g., having multi-lobed shaped outlets);

DETAILED DESCRIPTION

Figure 1:
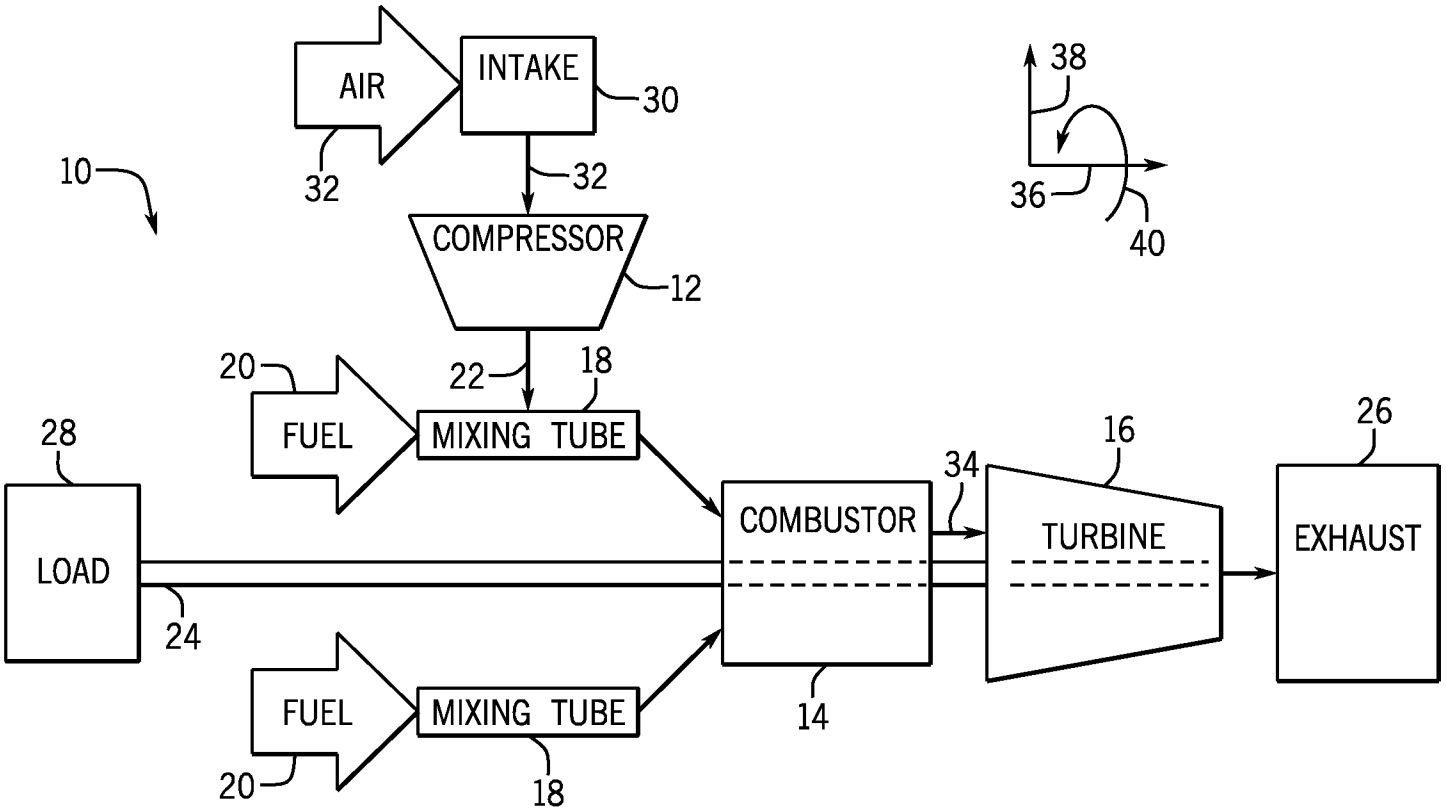
FIG. 1 is a block diagram of an embodiment of a turbine system having a multi-tube fuel nozzle.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to a combustor cap assembly for a multi-tube fuel nozzle, wherein the combustor cap assembly includes nozzles configured to control the characteristics of a flame (e.g., length, shape, etc.) downstream of the nozzle in a combustion region as well as production of emissions. For example, a combustor cap assembly for a multi-tube fuel nozzle includes a support structure that defines an interior volume for receiving an air flow. The combustor cap assembly also includes multiple mixing tubes within the interior volume, wherein each tube is configured to mix air and fuel to form an air-fuel mixture. The combustor cap assembly also includes a combustor cap removably coupled to the support structure. The combustor cap includes multiple nozzles integrated within the combustor cap.

Each nozzle is coupled to a respective mixing tube. Each nozzle of the multiple nozzles is coupled to a respective mixing tube of the multiple mixing tubes. In addition, each nozzle of the multiple nozzles includes a first end and a second end. The first end is coupled to the respective mixing tube of the multiple mixing tubes. The second end defines a non-round outlet for the air-fuel mixture. An inner surface of each mixing tube may include a first perimeter (e.g., having a round shape), while an inner surface of the second end at the non-round outlet of each nozzle may include a second perimeter (e.g., having a non-round shape such as an oval, triangle, square, multiple lobes, etc.). In certain embodiments, the second perimeter is larger than the first perimeter. The larger perimeter may provide more shear area for a flame to exist. In addition, the larger perimeter at the outlet of the nozzle increases the surface area at the hot side of the combustor cap for heat transfer to the exiting air-fuel mixture enabling more effective cooling of the hot side of the combustor cap (e.g., via convective cooling). In certain embodiments, the inner surface of each mixing tube includes a first cross-sectional area, the second end at the non-round outlet of each nozzle includes a second cross-sectional area, and the first and second cross-sectional areas are the same. In certain embodiments, the cross-sectional area may decrease or increase from mixing tube to the second end of the nozzle at the non-round outlet. The characteristics (e.g., shape, area, etc.) of the non-round outlet of the nozzle affect the characteristics of the flame. For example, the non-round outlet may shorten the length of the flame and/or affect the flame shape (e.g., generating smaller secondary flames adjacent a primary flame). By changing the characteristics of the flame, the production of emissions may be reduced (e.g., $NO_x$, CO, etc.). By reducing emissions, a combustor including the described combustor cap may be shortened. The presently described system may lower manufacturing costs, extend equipment lifetime, and/or lower emissions, for example.

Turning to the drawings, FIG. 1 illustrates a block diagram of an embodiment of a turbine system 10. As described in detail below, the disclosed turbine system 10 (e.g., a gas turbine engine) may employ a combustor cap, described below, which may improve system durability, operability, and reliability. As shown, the system 10 includes a compressor 12 (e.g., with one or more compression stages), one or more turbine combustors 14, and a turbine 16 (e.g., with one or more turbine stages). The turbine combustor 14 may include one or more mixing tubes 18, e.g., in one or more multi-tube fuel nozzles, configured to receive both fuel 20 and pressurized oxidant 22, such as air, oxygen, oxygen-enriched air, oxygen reduced air, or any combination thereof. Although the following discussion refers to the oxidant as the air 22, any suitable oxidant may be used with the disclosed embodiments. The mixing tubes 18 may be described as micromixing tubes, which may have outer diameters between approximately 0.5 to 5 centimeters. For example, the diameters of the tubes 18 may range between approximately 0.5 to 2, 0.75 to 1.75, 1 to 1.5, 0.5 to 5, 5 to 10, or 10 to 15 centimeters, and all subranges therebetween. The mixing tubes 18 may be arranged in one or more bundles of closely spaced tubes, generally in a parallel arrangement relative to one another. In this configuration, each mixing tube 18 is configured to mix (e.g., micromix) on a relatively small scale within each mixing tube 18, which then outputs a fuel-air mixture into the combustion chamber. In certain embodiments, the system 10 may include between 2 and 2500 mixing tubes 18, and the system 10 may use a liquid fuel and/or gas fuel 20, such as natural gas or syngas. Furthermore, the combustor 14 may contain a cap assembly described in more detail in FIG. 2 that includes a removable combustor cap, a support structure, and/or mixing tubes 18. The combustor cap may include nozzles configured to couple to respective tubes 18 that include non-round outlets to lower manufacturing costs, extend equipment lifetime, and/or lower emissions.

Compressor blades are included as components of the compressor 12. The blades within the compressor 12 are coupled to a shaft 24, and will rotate as the shaft 24 is driven to rotate by the turbine 16, as described below. The rotation of the blades within the compressor 12 compresses air 32 from an air intake 30 into pressurized air 22. The pressurized air 22 is then fed into the mixing tubes 18 of the turbine combustors 14. The pressurized air 22 and fuel 20 are mixed within the mixing tubes 18 to produce a suitable fuel-air mixture ratio for combustion (e.g., a combustion that causes the fuel to more completely burn) so as not to waste fuel 20 or cause excess emissions.

The turbine combustors 14 ignite and combust the fuel-air mixture, and then pass hot pressurized combustion gasses 34 (e.g., exhaust) into the turbine 16. Turbine blades are coupled to the shaft 24, which is also coupled to several other components throughout the turbine system 10. As the combustion gases 34 flow against and between the turbine blades in the turbine 16, the turbine 16 is driven into rotation, which causes the shaft 24 to rotate. Eventually, the combustion gases 34 exit the turbine system 10 via an exhaust outlet 26. Further, the shaft 24 may be coupled to a load 28, which is powered via rotation of the shaft 24. For example, the load 28 may be any suitable device that may generate power via the rotational output of the turbine system 10, such as an electrical generator, a propeller of an airplane, and so forth. In the following discussion, reference may be made to an axial axis or direction 36, a radial axis or direction 38, and/or a circumferential axis or direction 40 of the turbine system 10.

Figure 2:
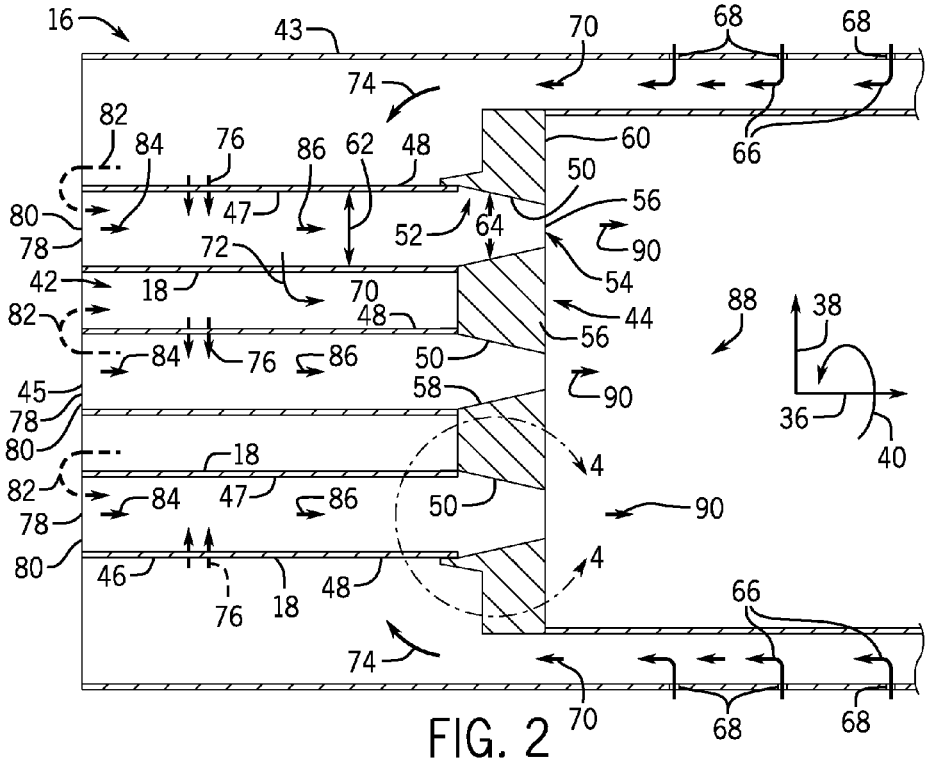
FIG. 2 is cross-sectional side view of an embodiment of a portion of a combustor of the turbine system of FIG. 1 having a combustor cap with nozzles having non-round outlets integrated within the combustor cap.

FIG. 2 is a cross-sectional side view of a portion of the combustor 14 (e.g., combustor cap assembly) having a multi-tube fuel nozzle 42 and a combustor cap 44 with non-round outlets 56 for the air-mixture low from the mixing tubes 18 of the multi-tube fuel nozzle 42. The combustor 16 includes an outer casing or flow sleeve 43 (e.g., support structure) and an end cover 45. Multiple mixing tubes 18 are disposed or mounted within an internal volume of the outer casing 43 of the combustor 16. Each tube 18 includes an inner surface 47 that defines a round (i.e., circular) perimeter (see FIG. 3). Each mixing tube 18 extends from an upstream end portion 46 (e.g., adjacent the end cover 45) to a downstream end portion 48 (e.g., adjacent the combustor cap 44). Each downstream end portion 48 of each mixing tube 18 is coupled, physically and thermally, to the combustor cap 44 (e.g., to a cool side or face of the combustor cap 44). As described in greater detail below, the combustor cap 44 includes nozzles 50 (e.g., integrated within the cap 44). Each downstream end portion 48 of each mixing tube 18 is coupled to a respective nozzle 50. Each nozzle 50 includes a first end 52 coupled to a respective mixing tube 18 and a second end 54 that defines an outlet 56 (e.g., non-round outlet). An inner surface 58 at the outlet 56 of the nozzle 50 defines a perimeter (see FIGS. 5-11) having a non-round shape (i.e., non-circular shape). The non-round shape may include an oval, square, triangle, or any other shape that is not a circle. For example, the non-round shape may include a plurality of lobes. For example, a multi-lobed shaped outlet may include 4 lobes, 8 lobes, or any other number of lobes. The characteristics (e.g., shape, area, etc.) of the non-round outlet 56 of the nozzle 50 may affect the characteristics of the flame (see FIGS. 12-13). For example, the non-round outlet 56 may shorten the length of the flame and/or affect the flame shape (e.g., generate smaller secondary flames adjacent a primary flame). In addition, the range of the length of the flame over a given range of temperature may be reduced (e.g., a range of flame length of approximately 5 to 30 centimeters (cm) may be reduced to a range of approximately 1 to 7.6 cm, where the lower and higher values of the range correspond to higher and lower temperatures, respectively) by the non-round outlet 56. By changing the characteristics of the flame, the production of emissions may be reduced (e.g., $NO_x$, CO, etc.). By reducing emissions, the combustor 16 including the described combustor cap 44 may be shortened. In addition, the non-round outlet 56 disposed downstream of a larger mixing tube 18 may enable the larger mixing tube 18 to act similar to a smaller mixing tube 18 with regard to flame characteristics (e.g., shorter flame) and/or productions of emissions (e.g., reduced emissions).

In certain embodiments, the perimeter at the non-round outlet 56 is larger than the perimeter defined by the inner surface 47 of the tube 18. The larger perimeter at the non-round outlet 56 provides more shear area for a flame to exist. In addition, the larger perimeter at the outlet 56 of the nozzle 50 increases the surface area at a hot side or face 60 of the combustor cap 44 for heat transfer to the exiting air-fuel mixture enabling more effective cooling of the hot side 60 of the combustor cap 44 (e.g., via convective cooling). In addition, each nozzle 50 may include cooling features to cool the combustor cap 44. For example, each nozzle 50 may include structures (see FIGS. 5-8) that extend radially 38 inward from the inner surface 58 of the nozzle 50 into a flow path of the air-fuel mixture through the nozzle 50.

The transition from the tube 18 (e.g., along inner surface 47) and through the first end 52 of the nozzle 50 to the non-round outlet 56 at the most distal portion of the second end 54 of the nozzle 50 (e.g., along inner surface 58) is smooth. The smooth inner surface (e.g., inner surfaces 47, 58) provide no areas for fluid (e.g., air-fuel mixture) flowing in the axial direction 40 to stagnate.

Also, the inner surface 47 of each mixing tube 18 defines a first cross-sectional area 62. The second end 54 at the non-round outlet 56 of each nozzle 50 includes a second cross-sectional area 64. In certain embodiments, the first and second cross-sectional areas 62, 64 are the same. In other embodiments, the cross-sectional area 62, 64 may decrease or increase from the mixing tube 62 to the second end 54 of the nozzle 50 at the non-round outlet 56. In certain embodiments, the inner surface 47 of each nozzle 50 includes first and second portions. The first portion radially 36 diverges along the axial direction 38 from the first end 52 to the second end 54, and/or the second portion radially converges along the axial direction 36 from the first end 52 to the second end 54 (see FIGS. 4-11). The combustor cap 44 may include nozzles 50 configured to couple to respective tubes 18 that include non-round outlets to lower manufacturing costs, extend equipment lifetime, and/or lower emissions.

Air (e.g., compressed air) enters the flow sleeve 43 (as generally indicated by arrows 66) via one or more air inlets 68, and follows an upstream airflow path 70 in an axial direction (e.g., opposite direction 36) towards the end cover 45. Air then flows into an interior flow path 72, as generally indicated by arrows 74, and proceeds to enter the plurality of mixing tubes 18 as indicated by arrows 76 into perforations through the tubes 18. In certain embodiments, the air may enter the mixing tubes 18 through an opening 78 disposed at an upstream end 80 of the upstream end portion 46 of each tube 18 as indicated by the dashed arrows 82. Fuel flows in the axial direction 36 into each tube 18 (e.g., via a fuel injector) as indicated by arrows 84. In certain embodiments, fuel may be radially 38 injected into each tube 18 (e.g., via fuel ports disposed along the tube 18). The air and fuel mix within the tubes 18 to form an air-fuel mixture that flows in the downstream direction 36 through the tubes 18 towards the combustor cap 44 as indicated by arrows 86. The tubes 12 inject the air-fuel mixture via the nozzles 50 into a combustion region or zone 88 (e.g. as indicated by arrows 90) in a suitable ratio for desirable combustion, emissions, fuel consumption, and power output.

Figure 3:
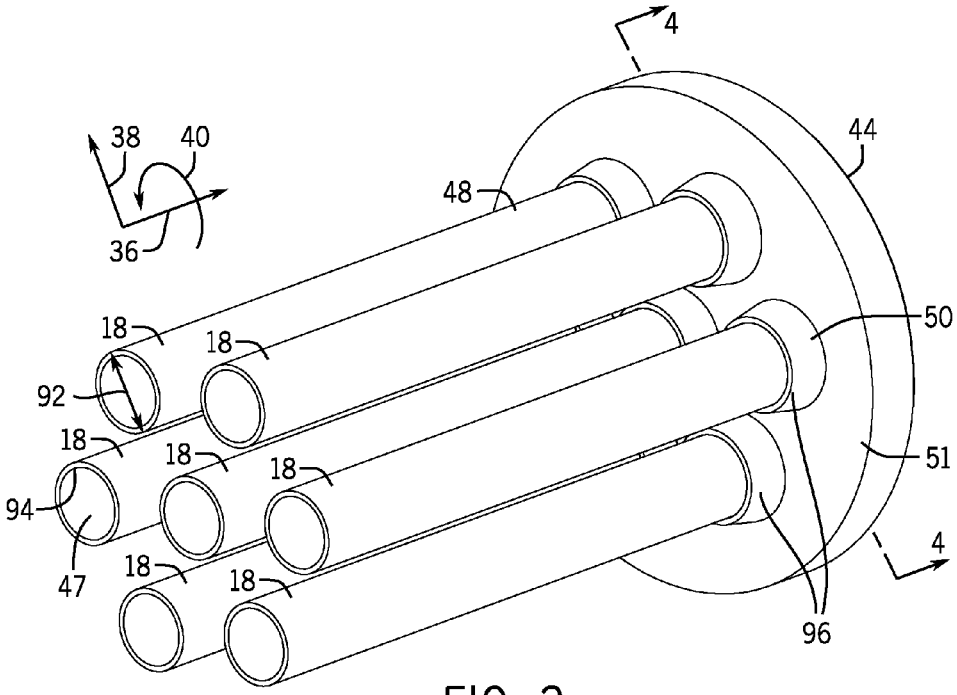
FIG. 3 is a perspective view of an embodiment of mixing tubes coupled to the combustor cap of FIG. 2.

FIG. 3 is a perspective view of an embodiment of the mixing tubes 18 coupled to the combustor cap 44. As depicted, the combustor cap 44 includes seven mixing tubes 18 coupled respectively to seven nozzles 50 of the combustor cap 44. The number of mixing tubes 18 may range from 2 to 2500. Similarly, the number of nozzles 50 may correspond to the number of mixing tubes 18 and range from 2 to 2500. Each tube 18 may include an outer diameter 92 ranging between approximately 0.5 to 15 centimeters. For example, the diameters 92 may range between approximately 0.5 to 2, 0.75 to 1.75, 1 to 1.5, 0.5 to 5, 5 to 10, or 10 to 15 centimeters, and all subranges therebetween. Also, the inner surface 47 of each tube 18 defines a round (i.e., circular) perimeter 94. As depicted, the mixing tubes 18 are coupled to their respective nozzles 50 on a cool side 56 of the combustor cap 44. The nozzles 50 include a portion 96 that extends in a downstream direction (e.g., opposite direction 36) from the cool side 51 of the combustor cap 44. In certain embodiments, the portion 96 of each nozzle 50 may include internally a shoulder that abuts a downstream end of the downstream end portion 48 of the tube 18.

Figure 4:
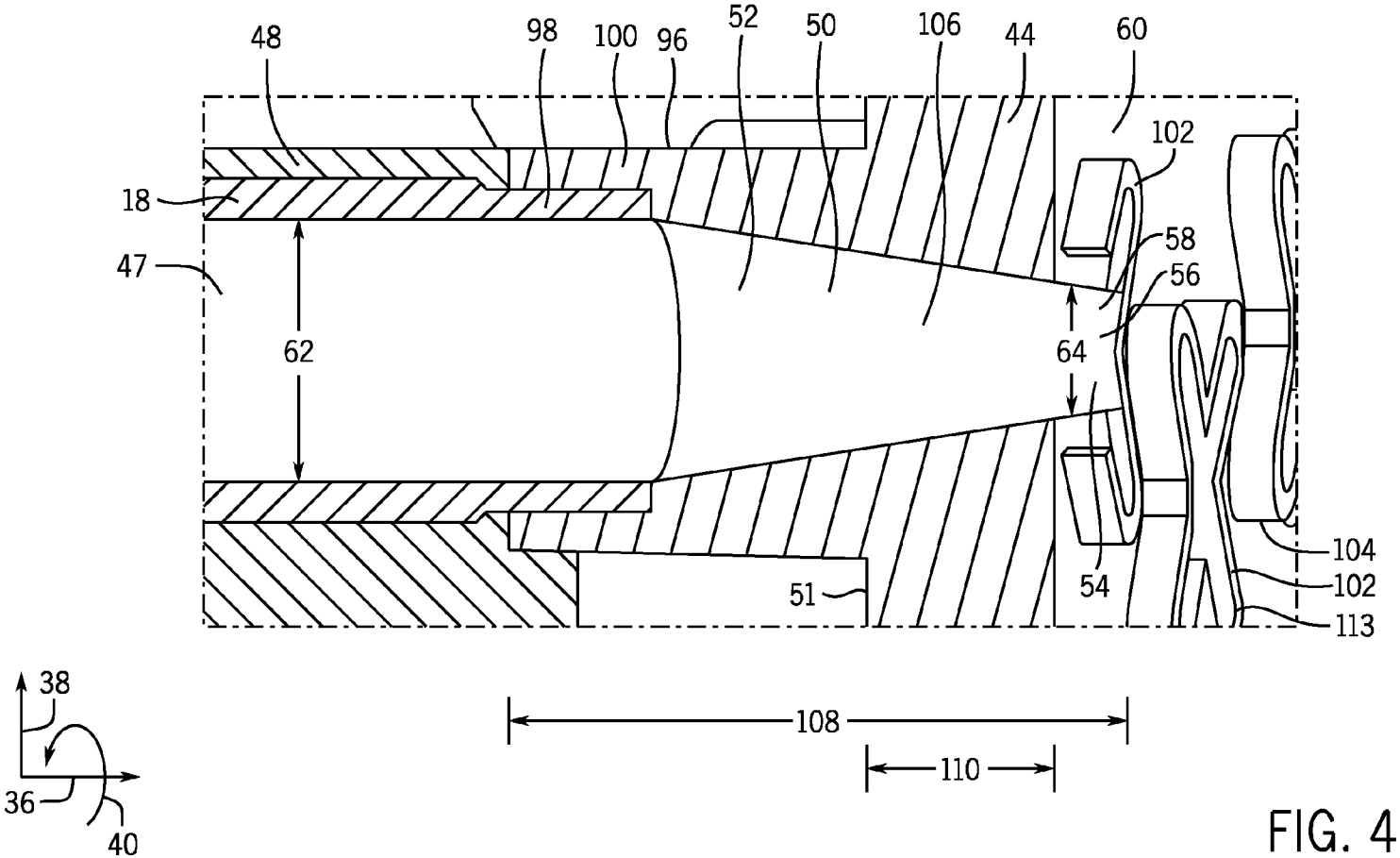
FIG. 4 is a cross-sectional side view with a slight perspective of an embodiment of a single nozzle integrated within the combustor cap of FIG. 2 coupled to a respective mixing tube, taken within line 4-4.

FIG. 4 is a cross-sectional side view with a slight perspective of an embodiment of a single nozzle 50 integrated within the combustor cap 44 of FIG. 2 coupled to a respective mixing tube 18, taken within line 4-4. The combustor cap 44 includes the nozzle 50 coupled to a respective mixing tube 18 via portion 96 of the nozzle 50. As depicted, a downstream end 98 of each tube 18 is coupled to a respective upstream end 52 (i.e., portion 96) of a respective nozzle 50. The downstream end 98 of each tube 18 abuts or interfaces with a respective shoulder 100 of a respective nozzle 50. In certain embodiments, the nozzles 50 may not include portion 96 and the mixing tube 18 may be removably or fixedly coupled (e.g., brazed, welded, threaded, DMLM, etc.) directly to the nozzle 50 at the cool side 51 of the combustor cap 44.

The inner surface 58 at the outlet 56 of the nozzle 50 defines a perimeter 102 (see also FIGS. 5-11) having a non-round shape (i.e., non-circular shape). As depicted, the perimeter 102 defines a multi-lobed shape (e.g., having 4 lobes 113). In certain embodiments, the non-round shape of the perimeter 102 may include other shapes such as an oval, square, triangle, or any other shape that is not a circle. Also, the multi-lobed shaped outlet 56 may include any number of lobes 113 ranging from 1 to 12 lobes 113 or any other number of lobes 113. As depicted, a portion 104 of the second end 54 of the outlet 56 of the nozzle 50 extends in the axial direction 36 beyond the hot face 60 of the combustor cap 44. In certain embodiments, the outlet 56 may be flush with the hot face of the combustor cap 44. The characteristics (e.g., shape, area, etc.) of the non-round outlet 56 of the nozzle 50 may affect the characteristics of the flame (see FIGS. 12-13). For example, the non-round outlet 56 may shorten the length of the flame and/or affect the flame shape (e.g., generate smaller secondary flames adjacent a primary flame). In addition, the range of the length of the flame over a given range of temperature may be reduced (e.g., a range of flame length of approximately 5 to 30 centimeters (cm) may be reduced a range of approximately 1 to 7.6 cm, where the lower and higher values of the range correspond to higher and lower temperatures, respectively) by the non-round outlet 56. By changing the characteristics of the flame, the production of emissions may be reduced (e.g., $NO_x$, CO, etc.). By reducing emissions, the combustor 16 including the described combustor cap 44 may be shortened. In addition, the non-round outlet 56 disposed downstream of a larger mixing tube 18 may enable the larger mixing tube 18 to act similar to a smaller mixing tube 18 with regard to flame characteristics (e.g., shorter flame) and/or productions of emissions (e.g., reduced emissions).

In certain embodiments, the perimeter 102 at the non-round outlet 56 is larger than the perimeter 94 (see FIG. 3) defined by the inner surface 47 of the tube 18. The larger perimeter 102 at the non-round outlet 56 provides more shear area for a flame to exist. In addition, the larger perimeter 102 at the outlet 56 of the nozzle 50 increases the surface area at the hot side or face 60 of the combustor cap 44 for heat transfer to the exiting air-fuel mixture enabling more effective cooling of the hot side 60 of the combustor cap 44 (e.g., via convective cooling). In addition, each nozzle 50 may include cooling features to cool the combustor cap 44. For example, each nozzle 50 may include structures 106 (see FIGS. 5-8) that extend radially 38 inward from the inner surface 58 of the nozzle 50 into a flow path of the air-fuel mixture through the nozzle 50. A height of the structures 106 may increase from the first end 52 to the second end 54. The structures 106 define the multi-lobed shape of the outlet 56 of each nozzle 50.

The transition from the tube 18 (e.g., along inner surface 47) and through the first end 52 of the nozzle 50 to the non-round outlet 56 at the most distal portion of the second end 54 of the nozzle 50 (e.g., along inner surface 58) is smooth. The smooth inner surface (e.g., inner surface 47, 58) provide no areas for fluid (e.g., air-fuel mixture) flowing in the axial direction 40 to stagnate.

Also, the inner surface 47 of each mixing tube 18 defines the first cross-sectional area 62. The second end 54 at the non-round outlet 56 of each nozzle 50 includes the second cross-sectional area 64. In certain embodiments, the first and second cross-sectional areas 62, 64 are the same. In other embodiments, the cross-sectional area 62, 64 may decrease or increase from the mixing tube 62 to the second end 54 of the nozzle 50 at the non-round outlet 56. The combustor cap 44 may include nozzles 50 configured to couple to respective tubes 18 that include non-round outlets 56 to lower manufacturing costs, extend equipment lifetime, and/or lower emissions.

Each nozzle 50 also includes a length 108 (see FIG. 4). The length 108 of each nozzle 50 may range from approximately 100 to 300 percent a length or height 110 of the other portion (i.e., without the nozzle 50) of the combustor cap 44. For example, the length 108 of the nozzle 50 may be approximately 100, 125, 150, 175, 200, 225, 250, 275, or 300 percent, or any other percent of the length 110.

FIG. 5 is a front view of the hot side 60 of the combustor cap 44 of FIG. 3. FIG. 5 illustrates the second ends 54 (e.g., downstream end) of the nozzles 50 described above. As depicted, the combustor cap 44 includes 7 outlets 56 for 7 nozzles 50. The number of outlets 56 and corresponding nozzles 50 may range from between 2 to 2500 for the combustor cap 44. The combustor cap 44 may be a single piece as illustrated in FIG. 5 or assembled from multiple sectors. As mentioned above, the inner surface 58 at the outlet 56 of each nozzle 50 defines the perimeter 102 having a non-round shape (i.e., non-circular shape). As depicted, the perimeter 102 defines a multi-lobed shape (e.g., having 8 lobes 113). In certain embodiments, the non-round shape of the perimeter 102 may include other shapes such as an oval, square, triangle, or any other shape that is not a circle. As depicted, the lobes 113 are defined by structures 106 that extend radially 38 inward from the inner surface 58 of the nozzle 50 into a flow path of an air-fuel mixture through the nozzle 50. As depicted, each nozzle 50 includes eight structures 106. The number of structures 106 (e.g., radial protrusions, fins, etc.) extending from the inner surface 58 of each nozzle 50 may range from 1 to 12. The structures 106 form a lobed cross-sectional shape for each nozzle 50. In other embodiments, the cross-sectional shape of each nozzle 50 may be triangular, elliptical, rectilinear, or any other shape.

As described above, a height 114 of the structures 106 may increase from the upstream end 52 (e.g., first end) to the downstream end 54 (see FIG. 4). In certain embodiments, a width 115 of the structures 106 may increase from the upstream end 52 to the downstream end 54. In addition, a width 116 of the lobes 113 (e.g., lobes) represents the characteristic diameter of the lobes 113. As mentioned above, the characteristics (e.g., shape, area, etc.) of the non-round outlet 56 of the nozzle 50 may affect the characteristics of the flame (see FIGS. 12-13). For example, the characteristic diameter (i.e., the width 116) of the lobes 113 affects the flame length. A shorter characteristic diameter may result in a shorter flame length.

An additional feature that may affect flame length is an angle 118 between each lobe 113. For example, a larger angle 118 between each lobe 113 may also reduce flame length. The angle 118 between each lobe 113 may range between approximately 5 to 180 degrees, 5 to 90 degrees, 90 to 180 degrees, 0 to 45 degrees, 45 to 90 degrees, 90 to 125 degrees, or 125 to 180 degrees, and all subranges therebetween. For example, the angle 118 may be approximately 10, 20, 30, 40, 50, 60, 70, 80, 90, 100, 110, 120, 130, 140, 150, 160, 170, or 180 degrees, or any other angle.

Figure 6:
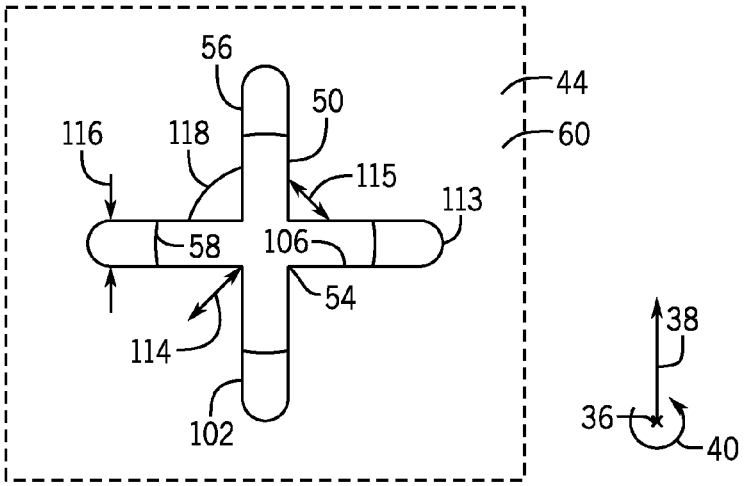
FIG. 6 is a front view of a portion of a hot side of the combustor cap of FIG. 2 illustrating a single non-round outlet of a nozzle (e.g., having 4 lobes)
Figure 7:
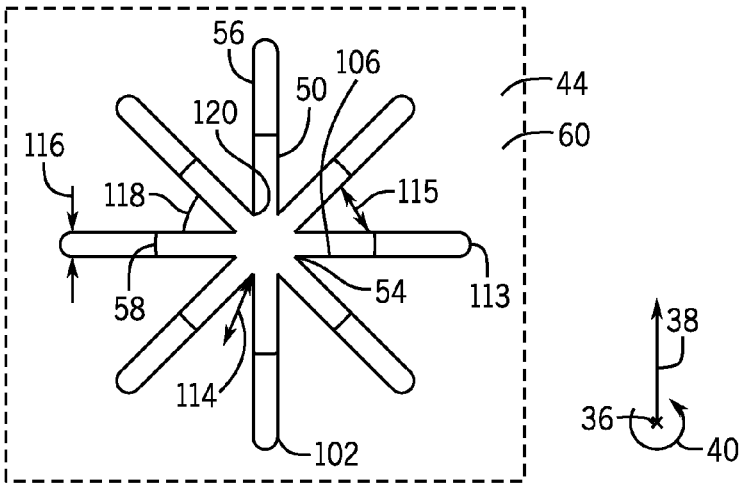
FIG. 7 is a front view of a portion of a hot side of the combustor cap of FIG. 2 illustrating a single non-round outlet of a nozzle (e.g., having 8 lobes)
Figure 8:
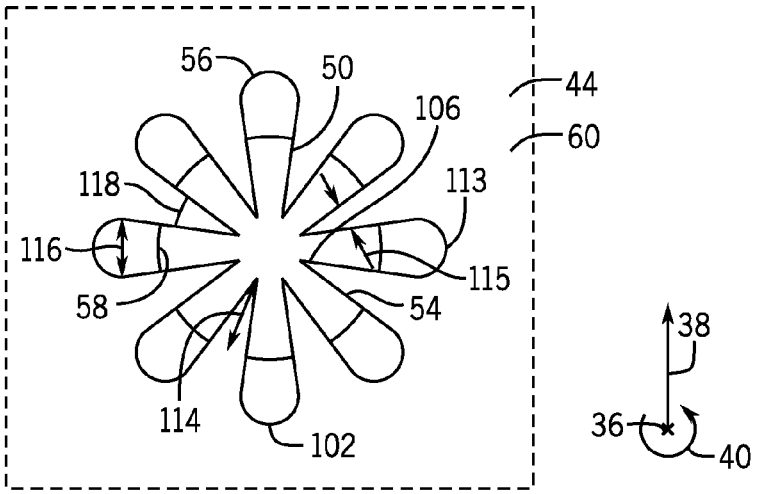
FIG. 8 is a front view of a portion of a hot side of the combustor cap of FIG. 2 illustrating a single non-round outlet of a nozzle (e.g., having 8 larger lobes)

As mentioned above, different multi-lobe perimeters 102 may be utilized at the outlet 56 of each nozzle 50. FIGS. 6-8 represent embodiments of the outlet 56 having different shaped, multi-lobe perimeters 102. Each embodiment of the multi-lobed perimeters 102 for the outlets 56 modifies the characteristics (e.g., flame length, shape, etc.) of the flame compared to a round or circular outlet 56. The perimeter 102 of each outlet 56 in FIGS. 6-8 includes multiple lobes 113. FIG. 6 includes a four-lobed perimeter 102. Besides having fewer lobes 113, the perimeter 102 in FIG. 6 has a larger angle 118 between each lobe 113 than the perimeter 102 in FIG. 5. Fewer lobes 113 (e.g., less overall characteristic diameter) and larger angles 118 may result in a shorter flame length for the outlet 56 in FIG. 6 compared to FIG. 5.

The eight-lobed perimeter 102 in FIG. 7 is similar to the perimeter 102 in FIG. 5, except the width 116 or characteristic diameter of each lobe 113 in FIG. 7 is less than the width 116 of each lobe 113 in FIG. 5. Thus, the lobes 113 in FIG. 7 may have an overall characteristic diameter that is less than the lobes 113 in FIG. 5, which may result in a shorter flame length for the outlet 56 in FIG. 7 compared to FIG. 5. In addition, the structures 106 in FIG. 7 have a sharper peak 120 (compared to FIG. 5).

The eight-lobed perimeter 102 in FIG. 8 is similar to the perimeters 102 in FIGS. 5 and 7, except the width 116 or characteristic diameter of each lobe 113 in FIG. 7 is generally greater than the width 116 of each lobe 113 in FIGS. 5 and 7. Thus, the lobes 113 in FIG. 8 may have an overall characteristic diameter that is greater than the lobes 113 in FIGS. 5 and 7, which may result in a different flame length and/or flame shape for the outlet 56 in FIG. 8 compared to FIGS. 5 and 7. In addition, the lobes 113 have a more rounded shape along the perimeter of each lobe 13 in FIG. 8 (compared to FIGS. 5 and 7).

Figure 9:
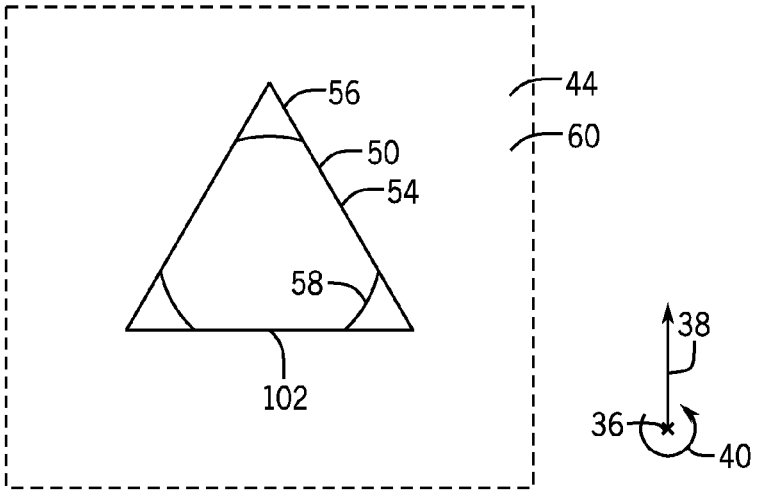
FIG. 9 is a front view of a portion of a hot side of the combustor cap of FIG. 2 illustrating a single non-round outlet of a nozzle (e.g., having a triangular shape)
Figure 10:
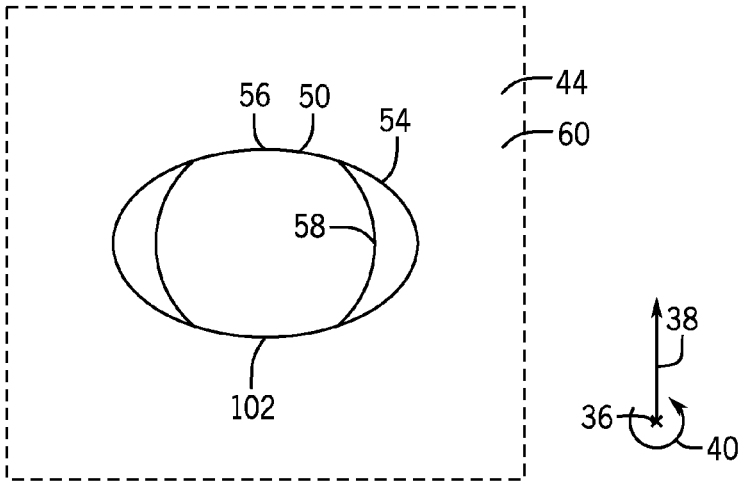
FIG. 10 is a front view of a portion of a hot side of the combustor cap of FIG. 2 illustrating a single non-round outlet of a nozzle (e.g., having an oval shape)
Figure 11:
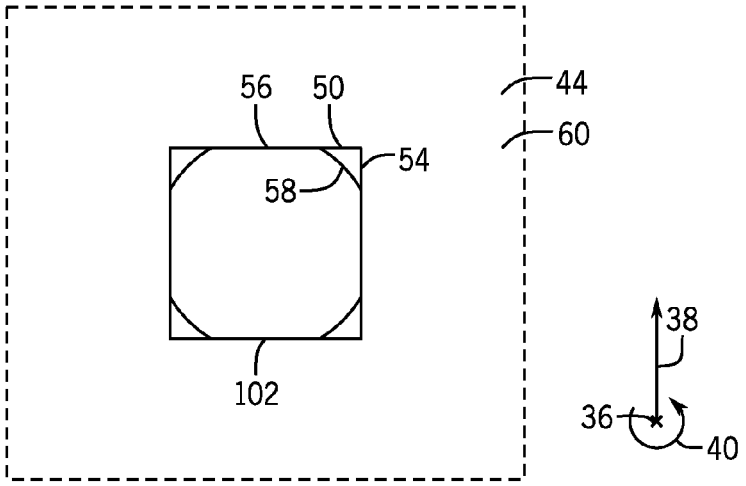
FIG. 11 is a front view of a portion of a hot side of the combustor cap of FIG. 2 illustrating a single non-round outlet of a nozzle (e.g., having a square shape)

As mentioned above, different perimeters 102 having non-round shapes besides a multi-lobed perimeter 102 may be utilized at the outlet 56 of each nozzle 50. FIGS. 9-11 represent embodiments of the outlets 56 having different shaped perimeters 102. Each embodiment of the multi-lobed perimeters 102 for the outlets 56 modifies the characteristics (e.g., flame length, shape, etc.) of the flame compared to a round or circular outlet 56. The perimeter 102 of each outlet 56 in FIGS. 6-8 includes multiple lobes 113. For example, the outlet 56 in FIG. 9 includes a triangular perimeter 102. The outlet 56 in FIG. 10 includes an elliptical or oval perimeter 102. The outlet 56 in FIG. 11 includes a rectilinear (e.g., square) perimeter 102.

Figure 12:
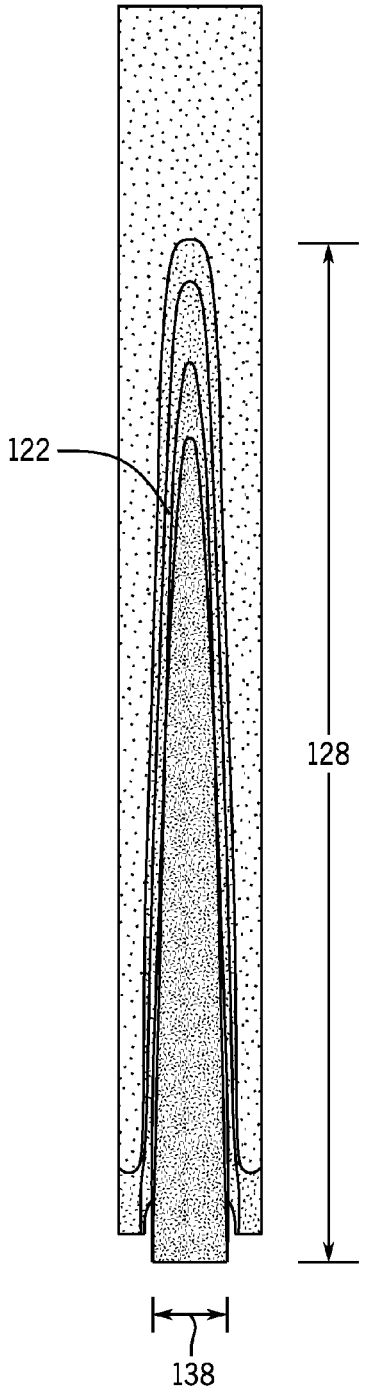
FIG. 12 is a representation of a flame generated with a round or circular shaped outlet of a nozzle.
Figure 13:
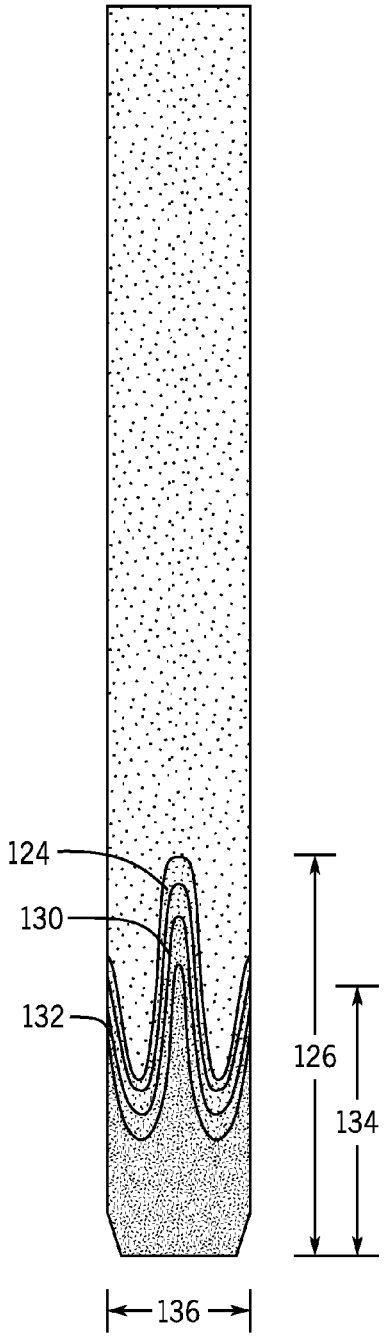
FIG. 13 is a representation of a flame generated with a non-round shaped outlet of a nozzle.

FIG. 12 illustrates a flame 122 generated using the nozzle 50 having a round or circular outlet 56. FIG. 13 illustrates a flame 124 generated using the nozzle 50 having the non-round or non-circular outlet 56 (e.g., 4-lobed outlet 56 in FIG. 6). The nozzles 50 used in FIGS. 12 and 13 are coupled to respective mixing tubes 18 having a same outer diameter. Also, the flames 122 and 124 are generated at a same temperature. As discussed above, the characteristics (e.g., shape, area, etc.) of the non-round outlet 56 of the nozzle 50 affect the characteristics of the flame. The non-round outlet 56 may shorten the length of the flame and/or affect the flame shape (e.g., generate smaller secondary flames adjacent a primary flame). For example, the flame 124 in FIG. 13 includes a length 126 shorter than a length 128 of the flame 122. In addition, the flame 124 includes a different shape than the flame 122. Flame 122 includes a single, long flame (compared to flame 124). Flame 124 includes a primary flame 130 and two secondary flames 132, all of which are shorter than the flame 122. The secondary flames 132 each include a length 134 shorter than the length 126 of the primary flame 130. As mentioned above, the larger perimeter of the non-round outlet 56 may provide more shear area for a flame to exist. For example, a width 136 of the flame 124 is greater than a width 138 of the flame 122.

Technical effects of the disclosed embodiments include providing non-round outlets 56 to the nozzles 50 integrated within the combustor cap 44. The characteristics (e.g., shape, area, etc.) of the non-round outlet 56 of the nozzle 50 affect the characteristics of the flame (e.g., length, shape, etc.) generated downstream of the nozzle 50. By changing the characteristics of the flame, the production of emissions may be reduced (e.g., $NO_x$, CO, etc.). By reducing emissions, the combustor 16 including the described combustor cap 44 may be shortened. In addition, the non-round outlet 56 disposed downstream of a larger mixing tube 18 may enable the larger mixing tube 18 to act similar to a smaller mixing tube 18 with regard to flame characteristics (e.g., shorter flame) and/or productions of emissions (e.g., reduced emissions).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a combustor cap assembly for a multi-tube fuel nozzle, comprising:

a support structure defining an interior volume configured to receive an air flow;

a plurality of mixing tubes disposed within the interior volume, wherein each mixing tube comprises a first upstream end and a first downstream end, and wherein each mixing tube is configured to receive fuel through the first upstream end, to mix air and the fuel to form an air-fuel mixture, and to discharge the air fuel mixture through the first downstream end; and a combustor cap removably coupled to the support structure downstream of the plurality of mixing tubes, wherein the combustor cap interfaces with a combustion chamber, and the combustor cap comprises a plurality of nozzles integrated within the combustor cap, each nozzle of the plurality of nozzles is configured to couple to a respective mixing tube of the plurality of mixing tubes, wherein each nozzle of the plurality of nozzles comprises a second upstream end configured to receive the air-fuel mixture and a second downstream end configured to discharge the air-fuel mixture into the combustion chamber, the second upstream end is configured to couple to and directly contact a respective first downstream end of the respective mixing tube of the plurality of mixing tubes, and the second downstream end defines a non-round outlet for the air-fuel mixture, and wherein each nozzle of the plurality of nozzles comprises an inner surface having first and second portions, the first portion radially diverges along an axial direction from the second upstream end to the second downstream end, and the second portion radially converges along the axial direction from the second upstream end to the second downstream end.

2. The system of claim 1, wherein an inner surface of each mixing tube of the plurality of mixing tubes comprises a first perimeter having a round shape, and the inner surface of the second end at the non-round outlet of each nozzle of the plurality of nozzles comprises a second perimeter having a non-round shape.

3. The system of claim 2, wherein the second perimeter is larger than the first perimeter.

4. The system of claim 3, wherein the inner surface of each mixing tube of the plurality of mixing tubes comprises a first cross-sectional area and the inner surface of the second end at the non-round outlet of each nozzle of the plurality of nozzles comprises a second cross-sectional area, and the first and second cross-sectional areas are the same.

5. The system of claim 1, wherein the combustor cap comprises a first surface configured to interface with the plurality of mixing tubes and a second surface opposite the first surface configured to interface with the combustion chamber, and the second downstream end axially extends beyond the second surface.

6. The system of claim 2, wherein the non-round shape comprises a multi-lobed shape.

7. The system of claim 1, wherein the inner surface of each nozzle of the plurality of nozzles comprises a cross-sectional area, and the cross-sectional area increases or decreases along the axial direction from the second upstream end to the second downstream end.

8. The system of claim 1, wherein each nozzle of the plurality of nozzles comprises one or more cooling features configured to cool the combustor cap, wherein the cooling features comprise structures that extend radially inward from an inner surface of each nozzle of the plurality of nozzles into a flow path of the air-fuel mixture through the respective nozzle.

9. The system of claim 1, comprising a gas turbine engine, a combustor, or the multi-tube fuel nozzle having the combustor cap.

10. A system, comprising:

a combustor cap assembly for a multi-tube fuel nozzle, comprising:

a support structure defining an interior volume configured to receive an air flow;

a plurality of mixing tubes disposed within the interior volume, wherein each mixing tube comprises a first upstream end and a first downstream end, and wherein each mixing tube is configured to receive fuel through the first upstream end, to mix air and the fuel to form an air-fuel mixture, and to discharge the air fuel mixture through the first downstream end; and a combustor cap removably coupled to the support structure downstream of the plurality of mixing tubes, wherein the combustor cap interfaces with a combustion chamber, and the combustor cap comprises a plurality of nozzles integrated within the combustor cap, each nozzle of the plurality of nozzles is configured to couple to a respective mixing tube of the plurality of mixing tubes, and wherein each nozzle of the plurality of nozzles comprises a second upstream end configured to discharge the air-fuel mixture into the combustion chamber and a second downstream end configured to discharge the air-fuel mixture into the combustion chamber, the second upstream end is configured to couple to and directly contact a respective first downstream end of the respective mixing tube of the plurality of mixing tubes, and the second upstream end defines a non-round outlet for the air-fuel mixture.

11. The system of claim 10, wherein an inner surface of each mixing tube of the plurality of mixing tubes comprises a first perimeter having a round shape, and an inner surface of the second downstream end at the non-round outlet of each nozzle of the plurality of nozzles comprises a second perimeter having a non-round shape.

12. The system of claim 11, wherein the second perimeter is larger than the first perimeter.

13. The system of claim 12, wherein the inner surface of each mixing tube of the plurality of mixing tubes comprises a first cross-sectional area and the inner surface of the second downstream end at the non-round outlet of each nozzle of the plurality of nozzles comprises a second cross-sectional area, and the first and second cross-sectional areas are the same.

14. The system of claim 11, wherein the non-round shape comprises a multi-lobed shape.

15. The system of claim 11, wherein an inner surface of each nozzle of the plurality of nozzles comprises a cross-sectional area, and the cross-sectional area increases or decreases along an axial direction from the second upstream end to the second downstream end.

16. A system, comprising:

a combustor cap assembly for a multi-tube fuel nozzle, comprising:

a support structure defining an interior volume configured to receive an air flow;

a plurality of mixing tubes disposed within the interior volume, wherein each mixing tube comprises a first upstream end and a first downstream end, and wherein each mixing tube is configured to receive fuel through the first upstream end, to mix air and the fuel to form an air-fuel mixture, and to discharge the air fuel mixture through the first downstream end; and a combustor cap removably coupled to the support structure downstream of the plurality of mixing tubes, wherein the combustor cap interfaces with a combustion chamber, and the combustor cap comprises a plurality of nozzles integrated within the combustor cap, each nozzle of the plurality of nozzles is configured to couple to a respective mixing tube of the plurality of mixing tubes, wherein each nozzle of the plurality of nozzles comprises a second upstream end configured to receive the air-fuel mixture and a second downstream end configured to discharge the air-fuel mixture into the combustion chamber, the second upstream end is configured to couple to and directly contact a respective first downstream end of the respective mixing tube of the plurality of mixing tubes, and the second downstream end defines an outlet for the air-fuel mixture, and wherein an inner surface of each mixing tube of the plurality of mixing tubes comprises a first perimeter, an inner surface of the second downstream end at the outlet of each nozzle of the plurality of nozzles comprises a second perimeter, and the second perimeter is larger than the first perimeter.

17. The system of claim 16, wherein the first perimeter comprises a round shape and the second perimeter comprises a non-round shape.

18. The system of claim 17, wherein the inner surface of each mixing tube of the plurality of mixing tubes comprises a first cross-sectional area and the inner surface of the second downstream end at the non-round outlet of each nozzle of the plurality of nozzles comprises a second cross-sectional area, and the first and second cross-sectional areas are the same.

19. The system of claim 16, wherein the non-round shape comprises a multi-lobed shape.

20. The system of claim 19, wherein the inner surface of each nozzle of the plurality of nozzles comprises a cross-sectional area, and the cross-sectional area increases or decreases along an axial direction from the second upstream end to the second downstream end.

* * * * *